US005249108A

United States Patent [19]

Gary

[11] Patent Number: 5,249,108

[45] Date of Patent: Sep. 28, 1993

[54] MULTIPLE-POSITION DECORATIVE LIGHT BRACKET

[75] Inventor: Lonnie F. Gary, Libertyville, Ill.

[73] Assignee: Gary Products Group, Inc., Lubbock, Tex.

[21] Appl. No.: 891,447

[22] Filed: May 29, 1992

[51] Int. Cl.[5] ..... F21V 21/00

[52] U.S. Cl. ..... 362/388; 362/145; 362/393; 362/396; 248/291; 248/314

[58] Field of Search ..... 248/291, 314; 362/239, 362/250, 388, 396, 393, 145

[56] References Cited

U.S. PATENT DOCUMENTS

| | | | |
|---|---|---|---|
| D. 324,990 | 3/1992 | Gary | D8/354 |
| D. 325,866 | 5/1992 | Gary | D8/354 |
| 3,540,687 | 11/1970 | Cuva | 248/225 |
| 4,893,773 | 1/1990 | Fujimoto | 248/311.2 |
| 4,901,212 | 2/1990 | Prickett | 362/145 |
| 4,905,131 | 2/1990 | Gary | 362/249 |
| 4,974,128 | 11/1990 | Prickett | 362/145 |
| 5,024,406 | 6/1991 | Ketcham | 362/250 X |

*Primary Examiner*—Stephen F. Husar

*Attorney, Agent, or Firm*—Ross, Howison, Clapp & Korn

[57] ABSTRACT

Apparatus for installing and displaying exterior decorative lighting on a supporting structure such as the roof of a residence or office building. The apparatus comprises a base portion, face portion and a hinge assembly. The face portion has at least one means adapted for receiving a decorative light bulb and socket assembly. The base portion is adapted for insertion between adjoining layers of shingles or other building materials. The face portion is fastened to the base portion by means of the hinge assembly. The hinge assembly permits multiple positioning and adjustments of the display angle of the face portion, such as either perpendicular or parallel to the base portion.

17 Claims, 2 Drawing Sheets

MULTIPLE-POSITION DECORATIVE LIGHT BRACKET

TECHNICAL FIELD

This invention relates to devices useful for installing and displaying decorative lighting, and more particularly, to frictionally engaged support brackets adapted for mounting decorative lighting to structures such as residences and office buildings in a plurality of positions.

BACKGROUND OF THE INVENTION

Decorative lights are commonly temporarily placed on the exterior of residences and office buildings during holiday seasons. Typically purchased in "strings" which comprise numerous individual light bulb and socket assemblies, a variety of devices and methods for installing and displaying decorative lights are well known.

The present invention is directed toward a deficiency that has been encountered with the devices and methods previously used to install and display decorative lighting. In the past, installation of decorative lights has been limited to brackets which support the bulb and socket assemblies in one position only thereby limiting the ability of the user to adjust the lighting in different directions.

It is an object of the present invention to provide a flexible support bracket which is easily adjustable into a plurality of positions thereby enabling the user to direct the lighting of bulbs on a common string in multiple directions and enhance the user's design creating abilities.

SUMMARY OF THE INVENTION

According to the present invention, a bracket is provided that is capable of displaying decorative lighting in a plurality of positions. The subject bracket comprises a base portion and a face portion flexibly connected by a hinge assembly.

According to a preferred embodiment of the invention, a bracket for decorative lighting is provided that comprises a base portion adapted to be inserted between adjacent layers of building materials and a face portion comprising at least one means adapted to support and maintain said decorative lighting, said face portion being flexibly connected to said base portion by a hinge assembly adapted to adjust the angular pitch of said face portion to a plurality of alternate positions.

According to another preferred embodiment of the invention, a bracket for decorative lighting is provided that comprises a base portion and a face portion flexibly connected by a hinge assembly wherein said face portion lies in a direction substantially parallel to the major plane of said base portion when said hinge assembly is in its initial state and wherein said face portion lies in a direction substantially perpendicular to the major plane of said base portion when said hinge assembly is in an inverted position.

According to another preferred embodiment of the invention, a bracket for decorative lighting is provided which comprises a base portion, a face portion and a reciprocating hinge means for selectively supporting a decorative bulb and socket assembly in a first position perpendicular to the base portion or in a second position parallel to the base portion.

According to an alternate preferred embodiment of the invention, a bracket for decorative lighting is provided that comprises a base portion and a face portion flexibly connected by a hinge assembly wherein said face portion lies in a direction substantially parallel to the major plane of said base portion.

According to another alternate preferred embodiment of the invention, a bracket for decorative lighting is provided that comprises a base portion and a face portion flexibly connected by a hinge assembly wherein said face portion lies in a direction substantially perpendicular to the major plane of said base portion.

According to another preferred embodiment of the invention, a bracket for decorative lighting is provided that comprises a hinge assembly formed by a head member flexibly connected to a foot member.

According to another preferred embodiment of the invention, a bracket for decorative lighting is provided that comprises a base portion and a face portion flexibly connected by a hinge assembly wherein said hinge assembly comprises a head member attached to said face portion and flexibly connected to a foot member, wherein said foot member is flexibly connected to said base member.

According to another preferred embodiment of the invention, a bracket for decorative lighting is provided that comprises a base portion and a face portion flexibly connected by a hinge portion wherein said hinge assembly further comprises two oppositely positioned L-shaped face support members and a head member flexibly connected to a foot member located between said L-shaped face support members.

According to another preferred embodiment of the invention, a bracket for decorative lighting is provided that comprises a base portion and a face portion flexibly connected by a hinge assembly wherein said face portion defines an aperture adapted for use with decorative light bulbs and sockets of different sizes.

According to another preferred embodiment of the invention, a bracket for decorative lighting is provided that comprises a base portion and a face portion flexibly connected by a hinge assembly wherein said face portion comprises a substantially U-shaped segment; side arms of the U-shaped segment extend from the hinge assembly, curving toward each other, defining at least one aperture and ending close to each other at the remote end opposite said hinge assembly, further defining a notch at the remote end.

BRIEF DESCRIPTION OF THE DRAWINGS

The apparatus of the invention is further described and explained in relation to the following figures of the drawings wherein.

DESCRIPTION OF THE PREFERRED EMBODIMENT

Figure 1:
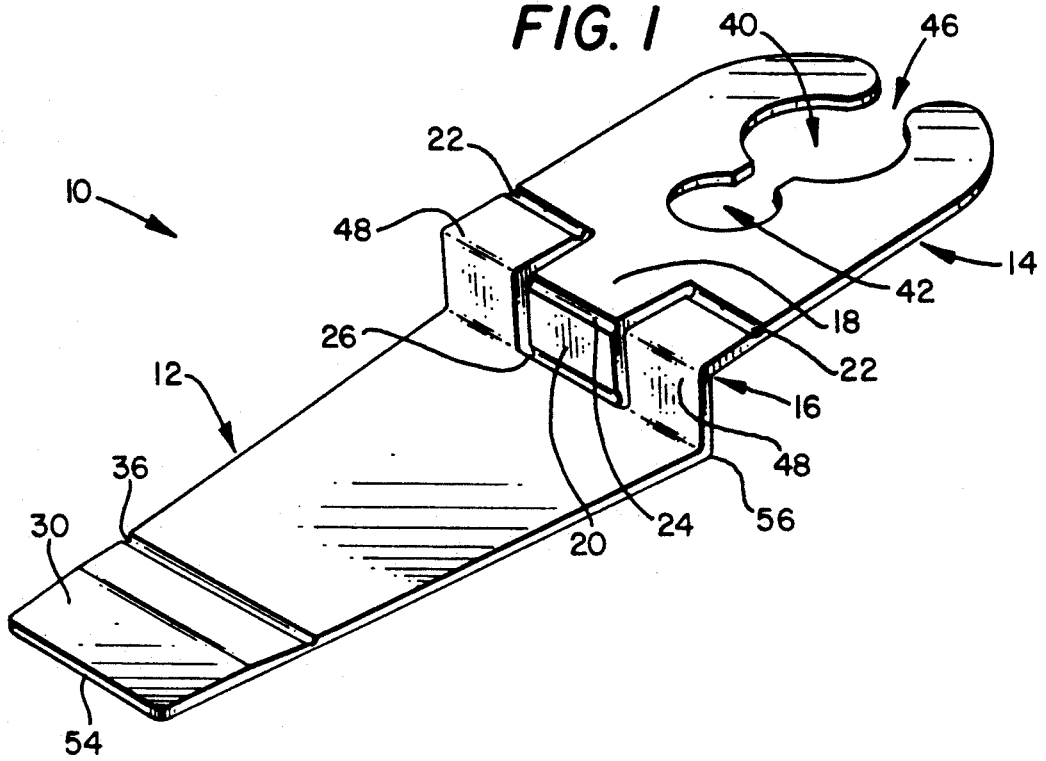
FIG. 1 is a perspective view of a preferred embodiment of the present invention with the face portion in a horizontal position.

Referring to FIG. 1, decorative light support bracket 10 preferably comprises base portion 12, face portion 14, and hinge assembly 16. Decorative bracket 10 is preferably unitarily molded from a polymeric resin such as plastic. When installed onto a building structure such as the roof of a residence or office building, decorative bracket 10 preferably supports, maintains and displays a decorative lighting assembly 50 in an adjustable relation to the surface of the building structure.

Figure 2:
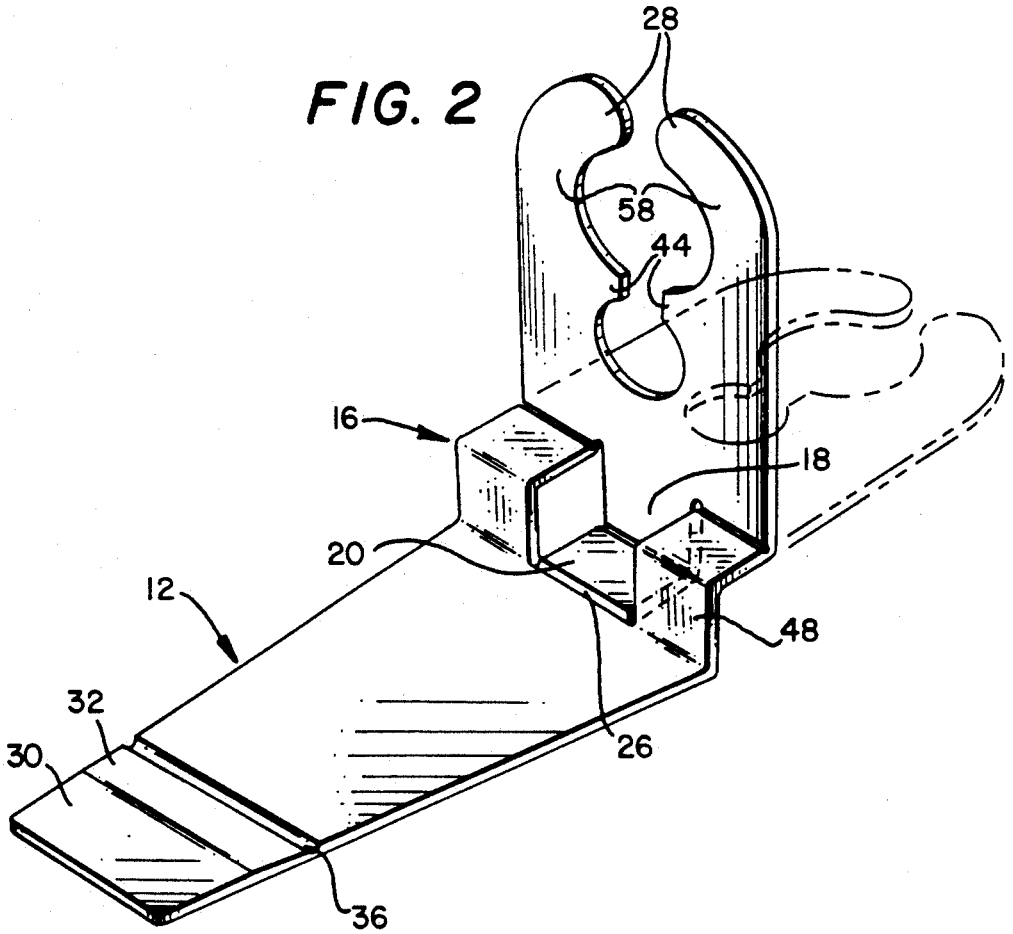
FIG. 2 is a perspective view of a preferred present invention with the face portion in a vertical position.
Figure 3:
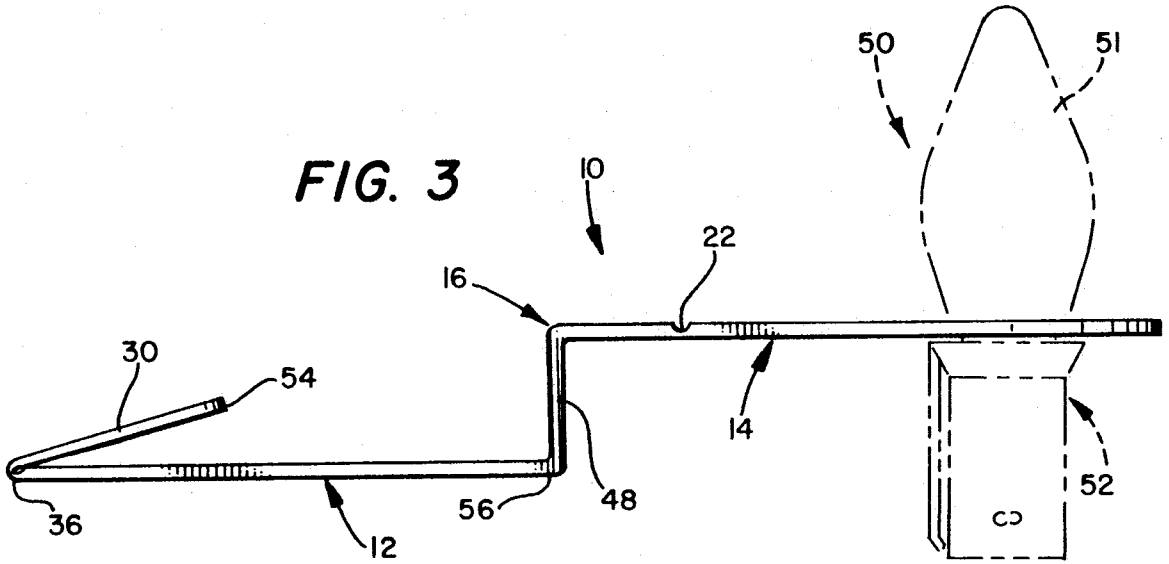
FIG. 3 depicts a side elevation view of the apparatus shown in FIG. 1.
Figure 4:
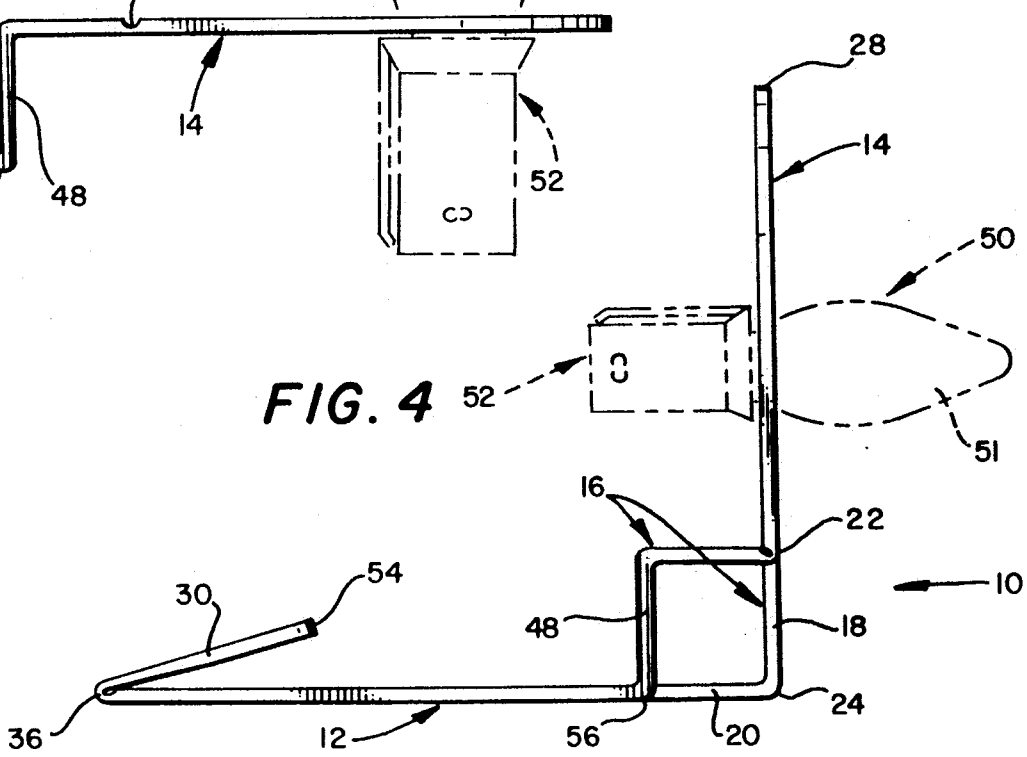
FIG. 4 depicts a side elevation view of the apparatus shown in FIG. 2.

Base portion 12 preferably comprises an elongated shape, slightly tapered from distal end 56 toward proximal end 54. Referring to FIGS. 1–4, base portion 12 is adapted to be manually inserted between adjacent and overlapping layers such as shingles or other building material of the structure wherein it remains frictionally engaged until manually removed. Proximal end 54 is preferably further defined by tab 30. Tab 30 comprises reduced zone 32 and tab fold line 36. When folded toward face portion 14 as shown in FIGS. 3 and 4, tab 30 increases the frictional engagement between bracket 10 and adjacent layers of the building materials.

Face portion 14 preferably comprises a semi-oblong shape, defining a plurality of apertures 40 and 42 of varying diameters separated by opposed shoulders 44. Referring to FIGS. 3 and 4, apertures 40 and 42 are adapted to provide support means to two commonly encountered commercially available sizes of decorative lighting assembly 50.

Hinge assembly 16 preferably comprises two L-shaped face support members 48, head member 18 and foot member 20. Referring to FIGS. 1 and 2, head member 18 is attached to face portion 14 and flexibly connected to foot member 20 along hinge fold line 24. Foot member 20 is flexibly connected to distal end 56 of base portion 12 along foot fold line 26. L-shaped face support members 48 are disposed on opposite sides of said flexibly connected head member 18 and foot member 20, with one end of face support member 48 being attached to distal end 56 of base portion 12 and the other end being flexibly connected to face portion 14 at face fold line 22.

As shown in FIGS. 1 and 3, when hinge assembly 16 is in its initial position, head 18 and foot member 20 hold face portion in a position parallel to the major plane of base portion 12. This is accomplished when head member 18 is in a longitudinal position parallel to base portion 12 and foot member 20 is in a lateral position perpendicular to base portion 12. In this configuration, decorative bulb 51 and socket 52 are held in a stationary vertical position, perpendicular to base portion 12, in either an upright direction as shown in FIG. 3 or inverted (not shown).

Application of manual force along hinge fold line 24 and face fold line 22 cause head member 18 and foot member 20 to switch directions by ninety degrees. Referring to FIGS. 2 and 4, head member 18 is now in a lateral position perpendicular to base potion 12, whereas foot member 20 is now in a longitudinal position in the same plane as base portion 12. As shown in FIG. 4, decorative lighting assembly 50 is now held in a stationary horizontal position parallel to base portion 12 with bulb 51 facing either away from or toward base portion 12. It should be understood and appreciated by one skilled in the art that hinge assembly 16 can be designed to permit the pitching of face portion 14 in a wide range of stationary angles from the major plane of base portion 12, by varying the size and shape of face support 48, head member 18 and foot member 20.

Referring to FIGS. 1–4, according to another preferred embodiment of the invention, decorative bracket 10 comprises base portion 12, face portion 14 and reciprocating hinge means 16 for selectively supporting decorative bulb 51 and socket 52 in a first position perpendicular to base portion 12 as shown in FIG. 3 or in a second position parallel to base portion 12 as shown in FIG. 4.

According to another preferred embodiment of the invention, face portion 14 further comprises a substantially U-shaped member with two arm segments 58 flexibly connected to L-shaped face support members 48 along face fold lines 22 with the arm segments 58 curving from fold lines 22 towards each other at a remote end 28 and stopping to define notch 46 at remote end 28.

As shown in FIGS. 3 and 4, decorative light assembly 50 is inserted through notch 46 into aperture 40 or 42 of face portion 14. Once decorative lighting assembly 50 is fastened into aperture 40 or 42, hinge assembly 16 is flipped into its desired position, or prior to insertion of lighting assembly 50 if preferred.

Other alterations and modifications of the subject invention will become obvious to those of ordinary skill in the art upon reading this disclose, and it is intended that the present invention be limited only by the broadest interpretation of the appended claims to which the inventor may be legally entitled.

I claim:

1. An apparatus for supporting and displaying a decorative light bulb and socket assembly on a building structure, said apparatus comprising:

(a) an elongate base portion adapted to be inserted between adjacent and overlapping layers of said building structure;

(b) a face portion comprising at least one means for supporting and maintaining said decorative light bulb and socket assembly; and (c) a hinge assembly comprising means for selectively adjusting said face portion to a plurality of positions.

2. The apparatus of claim 1 wherein said base portion, face portion and hinge assembly are unitarily molded from a polymeric resin.

3. The apparatus of claim 1 wherein said hinge assembly further comprises a head member flexibly connected to a foot member.

4. The apparatus of claim 3 wherein said head member is attached to said face portion and said foot member is flexibly connected to said base member.

5. The apparatus of claim 3 wherein said hinge portion further comprises two L-shaped face support members oppositely disposed from said head member and said foot member.

6. The apparatus of claim 1 wherein said means adapted to support and maintain said decorative light bulb and socket assembly comprises at least one aperture.

7. The apparatus of claim 6 wherein said aperture further comprises a notch extending through said face portion.

8. The apparatus of claim 1 wherein said face member comprises a U-shape with two arm segments extending from said hinge assembly wherein said arm segments curve toward each other and end close to each other at a remote end opposite said hinge assembly and define at least one interior aperture with a notch at said remote end.

9. The apparatus of claim 1 wherein said base portion further comprises a friction enhancing means.

10. The apparatus of claim 9 wherein said friction enhancing means comprises at least one tab flexibly connected to said base portion.

11. An apparatus for supporting and displaying a decorative light bulb and socket assembly on a building structure, said apparatus comprising a base portion, a face portion and a reciprocating hinge means for selectively supporting said decorative light bulb and socket assembly in a first position perpendicular to said base member or in a second position parallel to said base member.

12. The apparatus of claim 11 wherein said base portion, face portion and reciprocating hinge means are unitarily molded from a polymeric resin.

13. The apparatus of claim 11 wherein said base portion comprises means for insertion and frictional engagement between adjacent and overlapping layers of said building structure.

14. The apparatus of claim 13 wherein said frictional engagement means further comprises at least one tab flexibly connected to said base portion.

15. The apparatus of claim 11 wherein said face portion comprises means for supporting and maintaining said decorative light bulb and socket assembly.

16. The apparatus of claim 15 wherein said supporting means comprises at least one aperture.

17. The apparatus of claim 16 wherein said aperture further comprises a notch extending through said face portion.

* * * * *

UNITED STATES PATENT AND TRADEMARK OFFICE

CERTIFICATE OF CORRECTION

PATENT NO. : 5,249,108
DATED : 09/28/93
INVENTOR(S) : Lonnie F. Gary

It is certified that error appears in the above-indentified patent and that said Letters Patent is hereby corrected as shown below:

On the title page, item [75], insert the following inventors:

--Ronald J. Roberson ; Stephen L. Fillipp; both of Lubbock, TX --

Signed and Sealed this

Twenty-first Day of July, 1998

Bruce Lehman

*Attest:*

BRUCE LEHMAN

*Attesting Officer*

*Commissioner of Patents and Trademarks*